US006156072A

United States Patent [19]

Usui et al.

[11] Patent Number: 6,156,072

[45] Date of Patent: Dec. 5, 2000

[54] MANUFACTURING METHOD OF FABRIC FOR INK JET PRINTING AND INK JET PRINTING METHOD

[75] Inventors: Hiromi Usui; Yutaka Masuda; Nobuyoshi Handa, all of Otu, Japan

[73] Assignee: Toray Industries, Inc., Tokyo, Japan

[21] Appl. No.: 08/283,721

[22] Filed: Aug. 1, 1994

Related U.S. Application Data

[63] Continuation of application No. 07/849,370, filed as application No. PCT/JP91/01570, Nov. 18, 1991, abandoned.

[30] Foreign Application Priority Data

Nov. 19, 1990 [JP] Japan ..... 2-313721

[51] Int. Cl.[7] ..... D06P 5/00; B41M 5/00; B41M 7/00; B41J 2/01

[52] U.S. Cl. ..... 8/115.6; 8/543; 8/499; 8/445; 8/457; 8/495; 8/501; 427/154; 427/155; 427/322; 427/323; 427/324; 106/20 D; 106/20 R; 106/25 A; 106/26 R; 106/38.51; 106/38.6; 106/162.1; 106/162.8; 106/162.81; 106/206.1; 106/236; 347/1

[58] Field of Search ..... 8/115.6, 543, 499, 8/445, 457, 495, 501; 427/154, 264, 288, 271, 155, 322, 323, 324; 106/20 D, 22 R, 20 R, 25 A, 26 R, 38.51, 38.6, 162, 218, 203, 236, 162.1, 162.8, 162.81, 206.1; 347/1

[56] References Cited

FOREIGN PATENT DOCUMENTS

| | | |
|---|---|---|
| 63-168382 | 7/1988 | Japan . |
| 2-84593 | 3/1990 | Japan . |
| 2-99677 | 4/1990 | Japan . |

*Primary Examiner*—Alan Diamond
*Attorney, Agent, or Firm*—Armstrong, Westerman, Hattori, McLeland & Naughton

[57] ABSTRACT

This invention relates to a method of manufacturing a fabric for ink jet printing and to an ink jet printing method for imparting to the fabric a clear and sharp image free from ink oozing in ink jet printing. Specifically, it relates to a method of manufacturing a fabric for ink jet printing which is characterized in that an aqueous treatment solution having a water-insoluble solvent dispersed or emulsified in an aqueous polymer solution is imparted to the fabric and dried; and to an ink jet printing method characterized in that the ink jet printing is made with the ink jet printing fabric used and that after developing, the pretreatment agent is removed by washing the fabric.

6 Claims, 1 Drawing Sheet

MANUFACTURING METHOD OF FABRIC FOR INK JET PRINTING AND INK JET PRINTING METHOD

Figure 1:
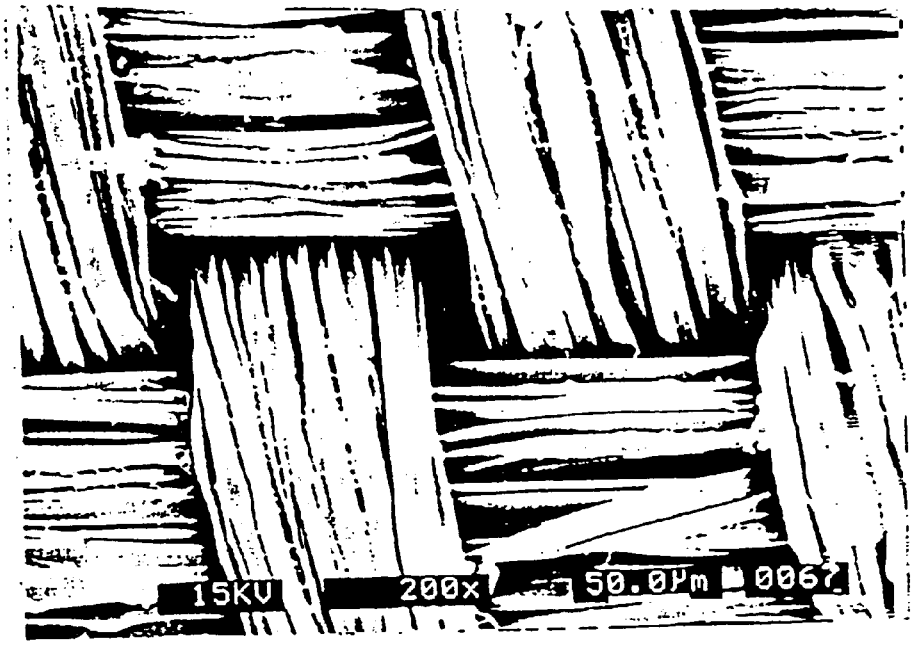

This application is a continuation of application Ser. No. 07/849,370, filed Aug. 20, 1992, abandoned, which is a §371 of international application PCT/JP91/01570 filed Nov. 18, 1991.

TECHNICAL FIELD

In ink jet printing, this invention relates to a method of manufacturing a fabric for ink jet printing for imparting a clear and sharp image free from ink oozing.

PRIOR ART

As a method of forming a pattern on a fabric, hand printing, roller printing, screen printing or transfer printing has been used conventionally, but such is a method which has a pattern previously formed on a screen, engrave roller or transfer paper. In the field of paper printing, however, an ink jet printing system has been developed recently and is now in practical use. Pattern formation according to the ink jet system has attracted attention in the field of textile industry in that it allows printing through combination with a pattern reader or a computer and thus without much time and cost, and thus attempts to directly apply the method to the fabrics have been made.

In this method, however, it is the most important problem for obtaining a fine image on the fabric to prevent ink oozing. To resolve the problem, for example, the following methods have been proposed.

(1) Method of applying a pretreatment to the fabric for preventing ink oozing.

(2) Method of adding an additive to the ink for prevention of oozing.

(3) Method of using both pretreatment and ink additive.

However, the method of using an additive in the ink for prevention of oozing as in the foregoing method (2) or (3) may be considerable in the effect of preventing oozing but is apt to induce deterioration of the ink discharge performance and reliability on account of the increasing ink viscosity, tackiness and insoluble component.

For the pretreatment of fabric under the method (1) above, there may be cited a water repellent treatment for preventing movement of the ink (Patent Publication No. SHO 60-99081) and a treatment with a water-soluble polymer for the purpose of enhancing water retention of the fabric (Patent Publication No. SHO 61-55277 and U.S. Pat. No. 4,702,742).

However, by merely imparting an aqueous solution of a water-soluble polymer, oozing of each drop of ink may be reduced, but the ink is not absorbed in a short time, and so when inks of different colors come into contact with each other, ink oozing occurs at the boundary of the colors, and a sharp pattern is not obtainable.

Then, for improving the water absorption and retention, a treatment method for increasing the surface area of the water-soluble polymer in the fabric has been examined. For example, Patent Publication No. HEI 2-112489 describes a method of using a treatment solution having a water-soluble polymer dispersed or emulsified in the form of fine particles in oil. According to this pretreatment method, the water-soluble polymer is imparted to the fabric in the form of fine particles, and so it has a large surface area and may well stop the oozing of ink. But, when dried, the fabric is in the state of being covered with the fine particles of the water-soluble polymer, and so the water-soluble polymer is apt to fall off the fabric, and thus it lacks stability in prevention of oozing. Further, because of the oil base, it was difficult to wash the pretreatment apparatus. To resolve these problems, the inventors variously investigated and came to the present invention.

DISCLOSURE OF THE INVENTION

In accordance with the present invention, an O/W type emulsion having a water-insoluble solvent dispersed or emulsified in an aqueous solution of a water-soluble polymer is imparted to a fabric which is then dried and subjected to ink jet printing to produce a clear and high grade image. That is, the present invention relates to a method of manufacturing a fabric for ink jet printing characterized by imparting an aqueous treatment solution having a water-insoluble solvent dispersed or emulsified in an aqueous solution of polymer to a fabric and drying the fabric and also to a method of ink jet printing characterized by using an ink jet printing fabric obtained by the foregoing method, applying the ink jet printing to the fabric, then through the developing process, washing the fabric with water to remove the pretreatment agent.

DRAWING

Figure 2:
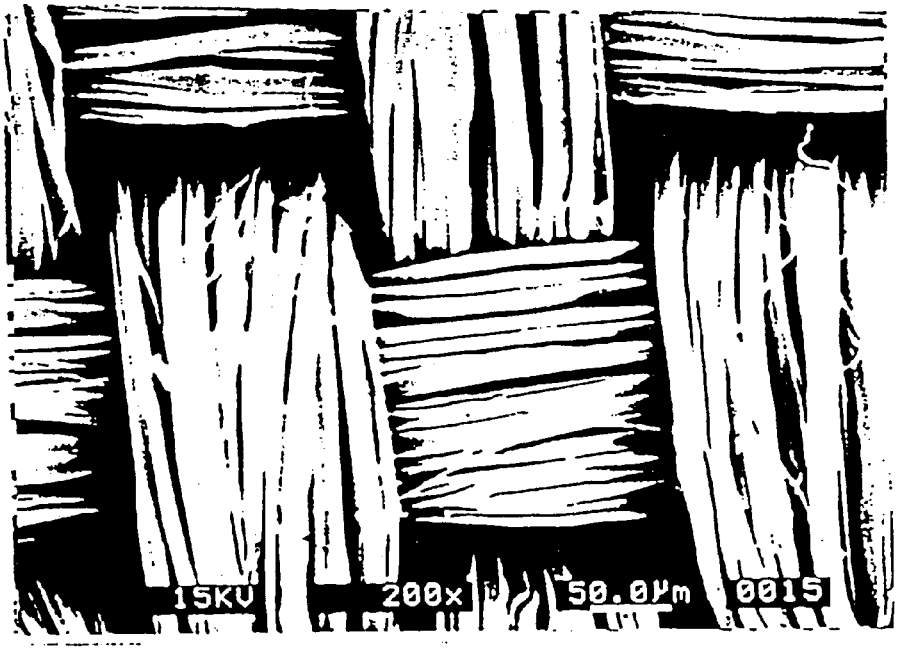

FIG. 1 is a photomicrograph of an ink jet printing fabric according to the method of the present invention as obtained in Example 1, and FIG. 2 is that of a fabric as obtained in Reference 2, each showing the surface condition of the fabric.

BEST FORM FOR IMPLEMENTING THE INVENTION

The present invention has been accomplished through investigation to the finding that a fabric having a water-soluble polymer present in the form of a number of fluffy bridge-like matters in the gaps between the fibers is remarkably distinguished in the workability of ink jet printing, level printing and prevention of ink oozing. Such fabric is obtained by using an O/W type emulsion having a water-insoluble solvent dispersed or emulsified in an aqueous solution of a water-soluble polymer as a treatment solution.

An aqueous solution provided by merely dissolving a water-soluble polymer, when it is imparted to a fabric and dried, has the viscosity increased and the volume reduced as the moisture evaporates from the surface during the drying process and, while gradually drawing the fibers to one another, recedes into the bundle of fibers finally into a solid matter filling the gaps between the fibers in such a form as to bond the fibers to one another. Under such condition, the fabric greatly hardens due to bonding of fibers to one another and thus involves difficulties of being distorted and having depressions and projections produced. Furthermore, when the ink is imparted, said distortion and depressions and projections increasingly occur to make it difficult to apply the ink jet printing evenly. Among other difficulties, when the ink is imparted, it spreads over the surface of fibers bound in a bundle and runs through the threads sooner than it is absorbed by the water-soluble polymer, and so a large quantity of the water-soluble polymer may be added, but the oozing is scarcely stopped, and a print of satisfactory grade is not obtainable.

On the other hand, according to the method of the present invention, a treatment solution of O/W type emulsion having a water-insoluble solvent dispersed or emulsified in an aqueous solution of a water-soluble polymer is used, and this emulsion provides an effect of roughing the film of the water-soluble polymer and having it lose the fluidity during the drying process and finally forms a number of fluffy bridges across the gaps between the fibers. In fact, when the fabric thus pretreated is observed by an electron microscope, the dried pretreatment agent is noted in the form of a number of fluffs of a length of several microns to several ten microns partly bridging the fibers in the gaps between the fibers.

The fabric treated according to the method of the invention is characterized in that the water-soluble polymer, when dried, presents a very great surface area and is, therefore, readily dissolved and that it is not in the form of a continuous film but in the form of fluffs so that it does not retain the ink on the surface but has it readily absorbed into the fabric. Also, the dried water-soluble polymer is extensively distributed in the gaps between the fibers, and so when it absorbs the ink jet ink, it turns into a homogenous color size inside the fabric structure to provide a very high level printing.

These features provide a distinguished effect of quickly absorbing the ink imparted onto the fabric, thickening the same and greatly enhancing the effect of preventing oozing. Moreover, because of less adhesion of the fibers to one another by the water-soluble polymer, the fabric is soft in feeling and is easy to handle. Furthermore, the water-soluble polymer is given in the form of a solution so that upon drying it may be fine fluffy pieces but is scarcely separated from the fibers.

These features are not obtainable with the W/O type emulsion. As described in the foregoing, the solution having the water-soluble polymer dispersed or emulsified in oil has not the water-soluble polymer dissolved but dispersed as fine particles in oil or emulsified in oil together with a small amount of water not enough to dissolve the polymer, resulting in little bonding to the fabric, and so the fine particles remaining on the fiber surface after drying are apt to fall off the fabric. Further, depending on the type of the water-soluble polymer used according to the material or dye, the treatment solution itself may be of poor stability and may have the particles settled, resulting in uneven fixture to the fabric to deteriorate the level printing and stability in prevention of ink oozing.

Thus, the method of the present invention features in using a treatment solution of O/W type emulsion having an aqueous solution of a water-soluble polymer used as a continuous phase and 5% or more of a water-insoluble solvent dispersed or emulsified in said solution. By this, the prevention of oozing was greatly improved.

FIG. 1 is a microscopically enlarged view of the surface of an ink jet printing fabric obtained according to the present invention in Example 1 described later, and from the drawing, the fibers having very small fluffy bridge-like matters of the water-soluble polymer will be clearly noted. FIG. 2 shows the surface of a fabric treated with an aqueous solution of a water-soluble polymer and dried as obtained in Reference 2 in which it is shown that the fibers are bonded to one another by said water-soluble polymer.

For the water-soluble polymer referred to in this invention, there may be listed the natural sizing materials (including semi-artificial sizing materials) and artificial sizing materials, and the natural sizing materials include starchy materials such as raw starch and solubilized starch, gummy materials such as locust bean, guiaic and tamarindo, and algal materials such as sodium alginate, and the semi-artificial sizing materials include cellulose materials such as methyl cellulose, hydroxymethyl cellulose and carboxymethyl cellulose.

The artificial sizing materials include the vinylic materials such as poly(vinyl alcohol) and poly(vinylmethyl ether), acrylic materials such as poly(acrylic acid), poly (methacrylic acid), polyacrylates, polymethacrylates and polyacrylamide, malic acid copolymers such as copolymers with styrene and vinyl acetate, and other compounds such as polyvinylpyrrolidone and poly(ethylene oxide).

Such water-soluble polymer may be used appropriately in combination with the printing ink to be used so that there is no difficulty caused to printing affinity or the like. As a particularly preferable one with little hazard to printing affinity, carboxymethyl cellulose (abbreviated as CMC in the following) or sodium alginate may be cited.

For prevention of the oozing, the water-soluble polymer is preferably contained in an amount of 1.0–20% in the treatment solution, and an amount of 2.0–10% is most preferably used. When contained in excess of 20%, infiltration of the pretreatment solution to the inside of the fabric is deteriorated, and the polymer forms a continuous layer and has the oozing preventive capacity degraded. Also, desizing becomes greatly difficult, and such is not economically advantageous. If less than 1.0%, the ink is scarcely absorbed, and so the oozing preventive effect is not appreciable.

Also, in order for the water-soluble polymer to be dissolved to form an O/W type emulsion, water is preferably contained in an amount of 30% or more in the treatment solution. More preferably, it is contained in an amount of 30%–90%.

The water-insoluble solvent referred to in this invention includes those solvents which are liquid at room temperature and substantially do not dissolve water and the water-soluble polymer, and as such solvents, aliphatic or aromatic hydrocarbons such as heptane, octane, nonane, decane, undecane, dodecane, tridecane, kerosine, mineral turpentine, benzene, toluene, xylene and petroleum benzine; hydrocarbon halides such as trichloroethylene, tetrachloroetylene, methylene chloride, chloroform, carbon tetrachloride, dichloroethane, dichloropropane, dichlorobutane and chlorobenzene; and plasticizers such as tributyl phosphate, dioctyl phosphate, dioctyl phthalate and dibutyl phthalate, are preferable. Of these, a hydrocarbon having less odor and boiling at 250° C. is preferably used as it scarcely remains on the surface of the fabric after drying, and as such hydrocarbon, mineral turpentine or kerosine may be cited. These may be used independently or in combination of two or more.

As for the content of the water-insoluble solvent in the treatment solution, 5% or more is required for obtaining bridging thin pieces of the water-soluble polymer. If contained in an amount of 70% or more, it is difficult to stably disperse or emulsify in water as an emulsion. Also, the water content is relatively reduced, and so the solution has the viscosity increased due to the water-soluble polymer and is hardly applicable to the fabric.

Therefore, for prevention of the oozing and stability of the dispersion or emulsion of the pretreatment agent, the water-insoluble solvent is contained in the treatment solution in an amount of preferably 5%–70% or, more preferably, 20%–60%. Also, in-order for the water-soluble polymer to have the surface area increased after drying and be discontinuously dispersed in the fabric to provide a high grade oozing preventive effect, it is preferable that the proportion of the dry solid component to the water-insoluble solvent in the pretreatment solution is 1/2.5–1/20. Provided, the dry solid component quoted in the present invention refers to the component of water-soluble polymer.

According to the present invention, a surface active agent is preferably added in order to stably emulsify the water-insoluble solvent in the aqueous solution. Here, the surface active agent is not particularly retricted so long as it forms an O/W type emulsion, and a non-ionic, high HLB agent is preferable used. For such surface active agent, there may be listed fatty esters of polyoxyethylene, alkyl polyoxyethylene ether, alkyl aryl polyoxyethylene ether, fatty esters of polyhydric alcohols and fatty esters of polyoxyethylene sorbitan.

When a high HLB surface active agent is mainly used with a low HLB one used concurrently, stability of the emulsion is further improved.

The amount of use in the treatment solution is preferably 0.1–10% or, more preferably, 0.5–4%.

Depending on the objective fabric and dye, there may be added a salt, anti-oxidant, anti-reduction agent and/or level dyeing agent to the treatment solution for improving the printing.

Summing up what has been described in the foregoing, the basic composition of the pretreatment solution according to the invention is shown below in percentage by weight (same in the following).

| | |
|---|---|
| Water-soluble polymer | 1–20% |
| Water-insoluble solvent | 5–70% |
| Surface active agent | 0.1–10% |
| Water | 30–90% |
| | 100 |

For example, the following composition may be cited as a preferable one.

| | |
|---|---|
| CMC[1] | 3–7% |
| Turpentine | 30–60% |
| Polyoxyethylene nonylphenyl ether | 1% |
| Water | 32–66% |
| | 100 |

Such solution is simply prepared by dissolving the water-soluble polymer in part of water to be used and mixing this aqueous solution of the water-soluble polymer to an O/W emulsion of the water-insoluble solvent emulsified in the remaining water with the surface active agent used, but the method of prepraration is not limited thereto. As the imparting method according to the invention, there may be used any of the pad, print and coating methods, but in view of the high viscosity of the treatment solution, a method of imparting the treatment solution by the print or coating method then pressing the fabric through a mangle to impregnate the solution into the fabric, is particularly preferable.

The amount of the pretreatment agent to be imparted to the fabric may be increased or decreased depending on the structure or material of the fabric or the amount of ink to be imparted, but as a pickup it is 50–300% by weight of the fiber.

The fabric may then be heated and dried according to the conventional method.

The ink jet referred to in the present invention is to discharge ink from a nozzle and transform the discharged ink liquid into drops to be controlled and used, and the ink jet method is classified into:

(1) Continuous discharge system (deflection type and divergency type); and (2) On-demand system (pressure pulse type, bubble jet type and electrostatic discharge type), and any of these methods may be employed.

Thereafter, the print fabric is generally subjected to the processes of developing and soaping. In the developing process, the dye is transferred from the water-soluble polymer to the fiber and fixed. Then, in the soaping process, the water-soluble polymer and other pretreatment agents are removed from the fabric, and for these processes, conventional facilities and methods are usable.

The effects of the fabric thus obtained for ink jet printing are as follows.

The ink jet printing fabric obtained according to the manufacturing method of the invention, when it comes into contact with an ink comprising water as a main medium, has the water-soluble polymer in the fabric instantly absorb the water and thicken to achieve the prevention of oozing, and so it is applicable to all of the water-based inks including inks having a disperse dye or any other water-insoluble dye dispersed and those of a water-soluble dye such as reactive dye and acid dye.

Also, the materials to which the method of the invention is applicable include artificial fibers (polyester, nylon, acryl, etc.), natural vegetable fibers (silk, hemp, etc.) and animal fibers (silk, wool, etc.), and so the method is a reasonable and generally applicable method. Further, the fabric structure is not particularly limited, and woven, knit and non-woven fabrics are usable.

Now, the main effects of the present invention will be summarized as below.

(1) Compared with the case of imparting the same amount of the water-soluble polymer as a mere aqueous solution, the oozing preventive effect is very high.

(2) Fine particles of the water-soluble polymer scarcely fall off the fabric as do in the case of a fabric treated with a W/O type emulsion.

(3) Being water based against the W/O type emulsion, the polymer is readily washed off with water to facilitate cleaning of the apparatus.

After ink jet printing and color development, the pretreatment agent is removed from the fabric in the washing process so that the texture and grade of the print fabric are not impaired.

The present invention will now be described with reference to examples but is not limited thereto.

EXAMPLE 1

Using carboxymethyl cellulose (abbreviated as CMC in the following) as a water-soluble polymer and mineral turpentine as a water-insoluble solvent, the pretreatment solution of the following composition was prepared.

| | |
|---|---|
| Fine Gum MC-8 (CMC; product of Daiichi Kogyo Seiyaku) | 5% |
| Water | 63% |
| Mineral Spirit A (Mineral turpentine, product of Nippon Oil) | 30% |
| Nonipol 100 | 2% |

(Surface active agent, polyoxyethylene nonylphenyl ether, HLB 13.3; product of Sanyo Kasei Kogyo)

To the water-soluble polymer dissolved in water, the surface active agent was added, and the mixture was stirred with mineral turpentine added little by little, and there was produced an O/W type emulsion.

This pretreatment solution was imparted to a silk fabric (Habutae) which was then squeezed through a mangle (squeezing rate: 60%) and dried on a tenter, and there was obtained a fabric for ink jet printing.

This pretreatment fabric was soft and hard lust lost to white. By this, it is obvious that the water-soluble polymer is differently fixed from that in Reference 2 shown later.

To determine the texture of the pretreatment fabric, the bending resistance was measured according to the cantilever method (JIS L1096). The result is shown in Table 1. Greater figure indicates harder fabric.

This pretreatment fabric had printing made under the ink jet conditions shown below.

| | |
|---|---|
| Ink jet system: | On-demand type |
| Nozzle diameter: | 75 microns |
| Drive frequency: | 4000 Hz |
| Resolution: | 8 dots/mm |

(Ink) Remasopl Turquoise Blue G Liquid (reactive dye, product of Hochst) Cibacron Red 6B Liquid (reactive dye, product of Ciba Geygy)

Each dye was prepared into an ink of the following composition.

| | |
|---|---|
| Reactive dye: | 30% |
| Ethylene glycol: | 20% |
| Ion exchange water: | 50% |

After printing, the fabric was subjected to steaming with saturated steam of 100° C. for 15 minutes to fix the dye then to water washing and soaping at 60° C. to remove the pretreatment agent and unfixed dye, and dried.

With this print sample, the length of oozing at the boundary of the two-color print and one-color print was measured. As for the oozing, the distance of movement (mm) of the color of two-color print to the adjacent color of one-color print was measured. Smaller figure indicates less oozing. Also, the grade of the print as a whole was evaluated through visual observation. The sample had the oozing suppressed well and had no distortion produced in the image, and a beautiful print was obtained. The result is also shown in Table 1. The water-soluble polymer was entirely removed from the fabric, and so the texture of the fabric was not at all degraded.

EXAMPLE 2

Similarly, dissolving sodium alginate in water, an O/W emulsion of the following composition was obtained.

| | |
|---|---|
| Snow Algin M (Sodium alginate, product of Fuji Kagaku Kogyo) | 3% |
| Sodium trichloroacetate | 5% |
| Water | 50% |
| Mineral Spirit A (Product of Nippon Oil) | 45% |
| Nonipol 100 | 2% |

(Surface active agent, product of Sanyo Kasei Kogyo)

This was treated to a cotton fabric (broad) under the same conditions to those of Example 1, and a print sample was obtained. The print image had the oozing well suppressed, with no color shading, and was of good grade. The result is shown in Table 1.

EXAMPLE 3

Similarly, dissolving sodium alginate in water, an O/W emulsion of the following composition was provided.

| | |
|---|---|
| Snow Algin M (Sodium alginate, product of Fuji Kagaku Kogyo) | 3% |
| Water | 35% |
| Mineral Sprint A (Product of Nippon Oil) | 60% |
| Nonipol 100 | 2% |

(Surface active agent, product of Sanyo Kasei Kogyo)

This was imparted to a nylon jersey (thick cloth) by the print method. The pickup was 100%. Treating under the same conditions to those in Example 1, a print sample was obtained. The printed image had the oozing suppressed well. Also, as the dye penetrated well into the fabric, the fabric was stretched, but it had no undyed portion produced on the surface. The result is shown in Table 2.

EXAMPLE 4

Similarly, dissolving CMC in water, an O/W emulsion of the following composition was obtained.

| | |
|---|---|
| Fine Gun SP-1 (CMC, product of Daiichi Kogyo Seiyaku) | 8% |
| Water | 45% |
| Mineral Spirit A (Product of Nippon Oil) | 20% |
| Nonipol 100 | 1% |

(Surface active agent, product of Sanyo kasei Kogyo)

This was treated to a nylon tricot fabric (thin cloth) under the same conditions to those of Example 1, and a print sample was obtained. The printed image had the ink oozing well suppressed and was good in level dyeing and dyed in dark colors. The result is shown in Table 2.

EXAMPLE 5

Similarly, dissolving CMC in water, an O/W emulsion of the following composition was obtained.

Fine Gum MC-8 5% (CMC, product of Daiichi Kogyo Seiyaku)

| | |
|---|---|
| Water | 45% |
| Mineral spirit A (product of Nippon Oil) | 50% |
| Nonipol 100 | 1% |

Surface active agent, product of Sanyo Kasei Kogyo)

This was imparted by coating to a nylon twill. The coating was 40 g/m$^2$. Thereafter, the fabric was treated and dried under the same conditions to those of Example 1, and an ink jet print sample was obtained.

Provided, disperse dye inks of the following composition were used for ink jet ink.

| | |
|---|---|
| Ink | |
| C.I. Disperse Yellow | 42 |
| C.I. Disperse Blue | 56 |
| (Disperse dyes) | |

Each dye was prepared into an ink of the following composition.

| | |
|---|---|
| Disperse dye | 10% |
| 1,4-butanediol | 20% |
| Ion exchange water | 50% |

After printing, the fabric was subjected to steaming with superheated steam of 170° C. for 7 minutes to fix the dye then to water washing and normal reduction clearing at 80° C. and dried.

The printed image had the oozing well suppressed and was good in level dyeing, being dyed in dark colors. The result is shown in Table 2.

References 1 and 2

An untreated silk fabric (Habutae) was taken as a sample of Reference 1.

Also, a silk fabric (Habutae) having an aqueous solution of the following composition imparted was taken as a sample of Reference 2.

| | |
|---|---|
| Fine Gum MC-8 | 5% |
| Water | 93% |
| Nonipol 100 | 2% |

(Surface active agent)

Each had ink jet printing made under the same conditions to those of Examples.

The print image of Reference 1 (untreated) was greatly oozing. The sample of Reference 2 had the fabric distorted on account of thick sizing, and so the image was more or less distorted. Also, the ink was oozing at parts where the ink was imparted rather greatly, and thus the print was inferior in grade to Example 1.

Reference 3

A treatment solution having a water-soluble polymer dispersed in oil was prepared according to the following composition. CMC was preveiously pulverized by a jet mill.

| | |
|---|---|
| Mineral Spirit A | 92.1% |
| Sorbitan monooleate | 2.1% |
| (Surface active agent) | |
| Fine Gum MC-8 | 5.0% |
| Polyoxyethylene sorbitan monooleate | 1.8% |

(Surface active agent)

This pretreatment fabric was soft but in a state of having white powder over the surface of the cloth. Under the same condition to those of Examples, it had ink jet printing given. The results are shown in Table 1. The print had the oozing prevented more or less better than Reference 2 but had large oozing from part to part and was lacking in level dyeing.

References 4 and 5

An untreated cotton broad cloth was taken as a sample of Reference 4. Also, preparing an aqueous solution of the following composition, a cotton broad cloth having the aqueous solution imparted was taken as a sample of Reference 5.

| | |
|---|---|
| Snow Algin M | 5% |
| Water | 93% |
| Sodium trichloroacetate | 5% |

Each had the ink jet printing given under the same conditions to those of Examples. The results are shown in Table 1.

The print image of Reference 4 (untreated) was oozing. The sample of Reference 5 was in the state of being solidly sized, and the image was slightly distorted. Further, the image was oozing at parts where the ink was sticking rather greatly, and the print as a whole was inferior to that of Example 2.

Reference 6

An aqueous solution was prepared according to the following composition, and it was imparted to a silk "Habutae" fabric.

| | |
|---|---|
| Fine Gum MC-8 | 5% |
| Water | 90% |
| Mineral Spirit A | 3% |
| Nonipol | 2% |

Under the same conditions to those of Examples, the ink jet printing was rendered. The result is shown in Table 1.

The print image was more or less oozing at parts where the ink was imparted rather greatly and was not much different from that of Reference 2.

TABLE 1

| | Materials | Bending resistance of treated fabric (mm) | Print oozing (mm) | Grade |
|---|---|---|---|---|
| Example 1 | Silk | 50 | 0.2 | ○ |
| Reference 1 | Silk | 50 | 5.5 | x |
| Reference 2 | Silk | 80 | 1.2 | Δ |
| Reference 3 | Silk | 50 | 0.5 | Δ |
| Reference 6 | Silk | 75 | 1.2 | Δ |
| Example 2 | Cotton | 60 | 0.1 | ○ |
| Reference 4 | Cotton | 33 | 3.3 | x |
| Reference 5 | Cotton | 92 | 0.8 | Δ |

TABLE 2

| | Materials | Dry solid/ turpentine weight ratio | Print oozing (min) | Grade |
|---|---|---|---|---|
| Example 3 | Nylon jersey | 1/20 | 0.2 | ○ |
| Example 4 | Nylon tricot | 1/2.5 | 0.4 | ○ |
| Example 5 | Polyester twill | 1/10 | 0.2 | ○ |

Possiblity of Industrial Application

The oozing preventive effect of the method of the present invention allows application of the ink jet printer to the field of textile printing as in the field of paper printing. Thus, pattern formation by means of pattern reader or computer is applicable, and so the cost of pattern formation is greatly reduced as compared with the conventional hand printing, roller printing, screen printing and transfer printing. The method of the invention is thus very advantageous for printing a variety of patterns each in a small quantity.

What is claimed is:

1. A method for manufacturing a fabric for ink jet printing comprising applying an aqueous dispersion or emulsion having a water-insoluble solvent dispersed or emulsified in an aqueous polymer solution containing water soluble polymer to the fabric and drying, wherein the content of said water-insoluble solvent is 20–70% by weight of said aqueous dispersion or emulsion and a water soluble polymer content in said aqueous dispersion or emulsion is 1/2.5–1/20 of the weight of the water-insoluble solvent.

2. A method of manufacturing a fabric for ink jet printing as set forth in claim 1 wherein the content of water is 30–90% by weight of said aqueous dispersion or emulsion.

3. A method of manufacturing a fabric for ink jet printing as set forth in claim 1 wherein the content of the water-soluble polymer is 1.0–20% by weight of said aqueous dispersion or emulsion.

4. A method of manufacturing a fabric for ink jet printing as set forth in claim 1, wherein the content of said water-insoluble solvent is 20–60% by weight of said aqueous dispersion or emulsion.

5. A method of ink jet printing, comprising printing an ink carried out by ink jet, on the fabric obtained in any of the claims 1, 2 or 3, then fixing the printing on the fabric, and washing the fabric.

6. A method for manufacturing a fabric for ink jet printing comprising applying an aqueous dispersion or emulsion having a water-insoluble solvent dispersed or emulsified in an aqueous polymer solution containing water soluble polymer to the fabric and drying, wherein the content of said water-insoluble solvent is 20–50% by weight of said aqueous dispersion or emulsion and a water-soluble polymer content in said aqueous dispersion or emulsion is 1/2.5–1/20 of the weight of the water-insoluble solvent.

* * * * *